US005467809A

United States Patent [19]

Arvedi et al.

[11] Patent Number: 5,467,809

[45] Date of Patent: Nov. 21, 1995

[54] LIQUID-COOLED INGOT MOLD FOR THE CONTINUOUS CASTING OF STEEL BILLETS IN THE FORM OF SLABS

[75] Inventors: Giovanni Arvedi, Cremona; Giovanni Gosio, Rovato, both of Italy; Ulrich Siegers, Berlin, Germany; Luciano Manini, Azzanello, Italy; Fritz-Peter Pleschiutschnigg, Duisburg, Germany; Lothar Parschat, Ratingen, Germany; Hans-Günther Thurm, Duisburg, Germany; Harald Lüdorff, Langenfeld, Germany

[73] Assignee: Mannesmann Aktiengesellschaft, Düsseldorf, Germany

[21] Appl. No.: 39,063

[22] PCT Filed: Sep. 23, 1991

[86] PCT No.: PCT/DE91/00761

§ 371 Date: Jun. 1, 1993

§ 102(e) Date: Jun. 1, 1993

[87] PCT Pub. No.: WO92/05898

PCT Pub. Date: Apr. 16, 1992

[30] Foreign Application Priority Data

| | | | |
|---|---|---|---|
| Oct. 2, 1990 | [DE] | Germany | 40 31 691.2 |
| Sep. 20, 1991 | [DE] | Germany | 41 31 829.3 |

[51] Int. Cl.[6] ..... B22D 7/00; B22D 11/04

[52] U.S. Cl. ..... 164/418; 164/459

[58] Field of Search ..... 164/418, 459, 164/436, 437

[56] References Cited

U.S. PATENT DOCUMENTS

| | | | |
|---|---|---|---|
| 2,767,448 | 10/1956 | Harter et al. . | |
| 4,635,702 | 1/1987 | Kolakowski | 164/418 |
| 4,716,955 | 1/1988 | Fastert | 164/475 |
| 4,926,930 | 5/1990 | Gay | 164/459 |
| 4,928,747 | 5/1990 | Pleschiutschnigg | 164/418 |
| 5,188,167 | 2/1993 | Perry | 164/418 |

FOREIGN PATENT DOCUMENTS

| | | | |
|---|---|---|---|
| WO87/00099 | 1/1987 | European Pat. Off. . | |
| 0249146 | 4/1987 | European Pat. Off. . | |
| WO88/01209 | 2/1988 | European Pat. Off. . | |
| 898667 | 12/1953 | Germany | 164/459 |
| 3501422A1 | 1/1985 | Germany . | |
| 3907351A1 | 3/1989 | Germany . | |
| 64-75146 | 3/1989 | Japan | 164/418 |
| 1199805 | 7/1970 | United Kingdom | 164/418 |
| 2212084 | 7/1989 | United Kingdom . | |

*Primary Examiner*—Kurt Rowan

*Attorney, Agent, or Firm*—Cohen, Pontani, Lieberman, Pavane

[57] ABSTRACT

A liquid-cooled plate mold with adjustable width for the continuous casting of billets from steel in the form of slabs, particularly for a slab thickness of less than 100 mm. The shape-imparting broad side plates (1) and narrow side plates (2) of the ingot mold are constructed in the direction of their transverse extension so as to increase in cross section for the billet, while the narrow side plates (2) extend substantially parallel to one another along the height of the ingot mold. Further, the broad side plates (1) are constructed so as to be concave at least in a region (3) of smallest slab width in such a way that, in cross section, the apex height (13) of the ingot mold wall forming a curve has a determined height relative to a rectangle inserted in the drawing. The shape of the billet side plates at the billet outlet end (5) corresponds to the billet format to be produced.

10 Claims, 6 Drawing Sheets

LIQUID-COOLED INGOT MOLD FOR THE CONTINUOUS CASTING OF STEEL BILLETS IN THE FORM OF SLABS

FIELD OF THE INVENTION

The invention concerns a liquid-cooled plate mold with adjustable width for the continuous casting of billets from steel in the form of slabs, particularly with a slab thickness of less than 100 mm.

BACKGROUND OF THE INVENTION

For the production of steel billets in the form of slabs, it is conventional to employ ingot molds whose free cross-sectional surface at the mold outlet corresponds to the desired billet format.

A corresponding ingot mold for a billet with oval cross section is known from U.S. Pat. No. 2,767,448. This mold is a corresponding ingot mold for a billet with oval cross so-called block ingot mold, i.e. the cross section of the ingot mold cannot be changed and it is not suitable for adjusting different billet formats. Further, an ingot mold is known from the prior art through DE 35 01 422 C2, whose narrow side walls can be adjusted to different billet dimensions and whose pour-in opening has an oval crosssectional surface. The ingot mold tapers toward the outlet end in such a way that the broad sides of the slab form parallel walls, while the narrow side walls diverge from the pour-in side to the pouring side, but retain their concave shape. Such an ingot mold is likewise known from EP 0 249 146 and U.S. Pat. No. 4,716,955.

Ingot molds are known from DE-A1 36 27 991 and WO 87/00099 which have plane surfaces on the narrow sides and convex broad sides along the entire height of the mold.

It must be noted that when using any of these ingot molds deformations occur in the billet shell when the billet passes through the mold, obviously because the billet shells contact the mold wall in different ways, and these deformations can result in cracks in the billet shell.

The object of the present invention is to improve the cooling conditions inside the continuous casting ingot mold and to prevent a blocking of the movement of the billet also in the width direction when the billet passes through the ingot mold so as to eliminate the risk of longitudinal cracks and fissures as far as possible.

SUMMARY OF THE INVENTION

In accordance with the present invention there is provided a liquid-cooled plate mould with adjustable width for the continuous casting of billets from steel in the form of slabs particularly for a slab thickness of less than 100 mm, the mould having a pour-in side, a slab outlet end and a direction of casting; the mould comprising: oppositely disposed broad side plates forming in the direction of casting curved mould walls; narrow side plates slidably disposed between the broad side plates for increasing the width of the slab along a region of adjustment extending from a smallest slab width to a relatively larger slab width, the narrow side plates being arranged substantially parallel to one another along the height of the mould; the broad side plates including a cavity extending along at least the smallest slab width, the cavity having a curve length, a chord length and a depth, the depth of the cavity of the curved mould being at most 12 mm per 1,000 mm slab width at the pour-inside of the mould; the shape of the broad side plates at the slab outlet end of the mould corresponding to the slab being produced; the broad side plates having a plane inner surface in the region of adjustment of the narrow side plates; and a plurality of ducts within the broad side plates for cooling the mould.

Preferably, the depth or chord continuously decreases from the pour-in side of the mould to the slab outlet end of the motlid and maybe, on the pour-inside, between 5 and 12 mm. The broad side plates are constructed so as to be concave at the slab outlet end of the mould in such a way that the depth of the mould walls forming the curve is still at least 0.5 to 2 mm as seen in cross-section thereof. Preferably, the depth is constant along a first section comprising a third of the mould height. The mould further comprises a second section terminating at approximately half the height of the mould and adjoining the first section of constant depth; the depth of the second section decreasing linearally in the direction of casting. The mould, further comprises a third section having a constant depth, the third section terminating at the motlid outlet end and adjoining the second section. Preferably, the curve length of a side wall in the direction of the width of the mould in the region of the smallest slab width is no more than 20% of the shrinkage of approximately 1% relative to the chord length. The mould, further comprises a center plane and the broad side plates comprise a surface facing the slab; and each cooling duct comprises a duct floor, the distance of the duct floor of the mould as seen from the top increases from the center plane of the mould to the narrow side plates relative to the surface of the broad side plates facing the slab. The mould, further comprises a central plane extending along the width of the mould; and a duct floor of the duct of the side wall lies in a plane parallel to the central plane at least in the upper half of the mould. The mould, further comprises a central plane extending along the width of the mould and the broad side plates are constructed as a plane surface in the region of adjustment and are inclined relative to the central plane commencing from the portion of the smallest slab width and are at a constant distance from one another from the pour-inside to the outlet end of the mould.

A concomitant possibility of the invention consists in that the reduction in the apex height can be effected linearly as well as according to an e-function. The camber provided according to the invention can also diverge from the circular shape and can be a polygon or a combination of polygonal lines and base elements. On the whole, a camber which is optimal for a rolling process, e.g. 1 mm per side, is provided at the foot of the ingot mold, i.e. at the billet outlet end. Accordingly, the following rolling billet guide is constructed in accordance with the camber of the billet. One of the advantages of this consists in that all rollers having the same diameter can be optionally converted with respect to their position and there is no need for deformation work with respect to changing the camber.

BRIEF DESCRIPTION OF THE DRAWINGS

The drawing shows an embodiment example of an ingot mold according to the invention.

DETAILED DESCRIPTION OF THE PRESENTLY PREFERRED EMBODIMENTS

Figure 1:
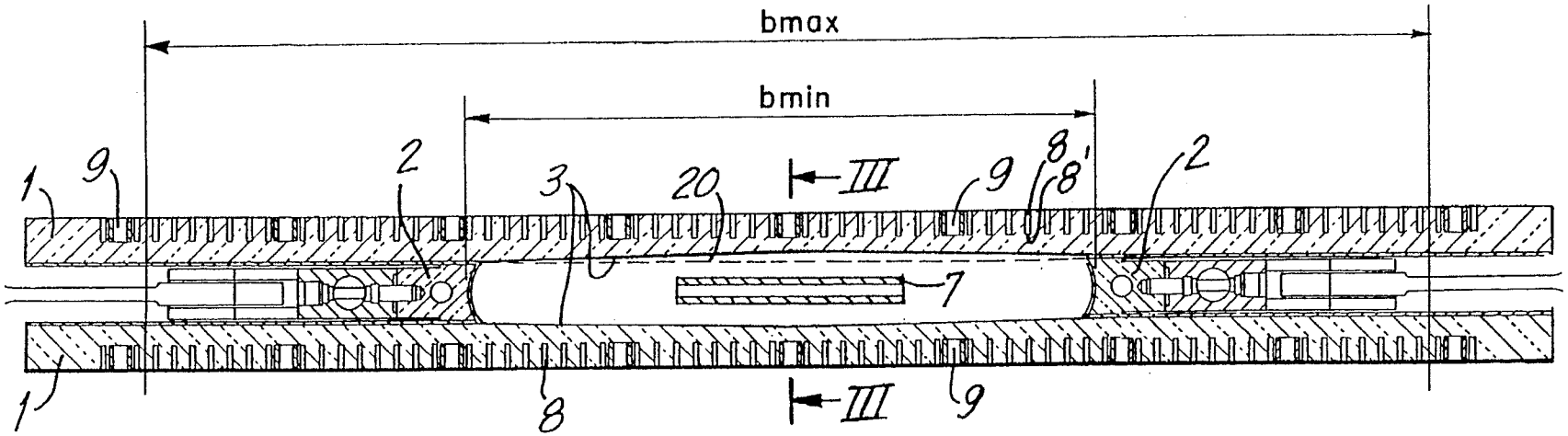
FIG. 1 shows a top view of an ingot mold in cross section I—I according to FIG. 3 for a minimum slab width.
Figure 5:
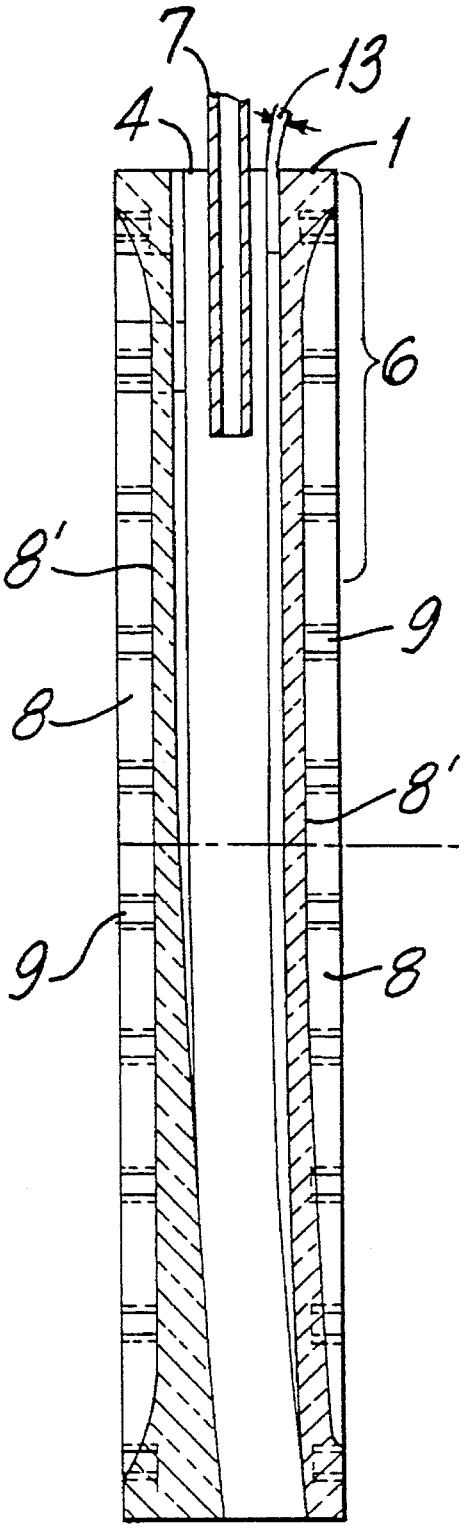
FIG. 5 shows another embodiment form in longitudinal section.

In the drawings, identical parts are provided with the same reference numbers. The ingot mold includes broad side plates 1 with narrow side plates 2 arranged between the latter so as to be displaceable. In the position shown in FIG. 1, the narrow side plates 2 define the smallest casting cross section attainable with this ingot mold, i.e. the smallest slab width (b min.). In this region 3, a flat, curved recess which extends along this region 3, as seen in cross section, is worked into the broad side plates i on the sides forming the casting cross section. The apex of the curve or apex height 13 relative to a rectangle inserted in the drawing—chord of the curve 20—at the pour-in side 4 of the ingot mold is a maximum of 12 mm along a portion 6 of approximately one third the height of the ingot mold and then decreases toward the lower edge 5 of the ingot mold to a curve height of I mm (FIG. 5). The selected camber at the pour-in side of the ingot mold corresponds to a maximum lengthening of the billet shell along the format width of 20% of the shrinkage.

| | |
|---|---|
| billet width | 1,000 mm |
| shrinkage (0.8%) | 8 mm |
| additional elongation maximum | 1.6 mm |

Figure 2:
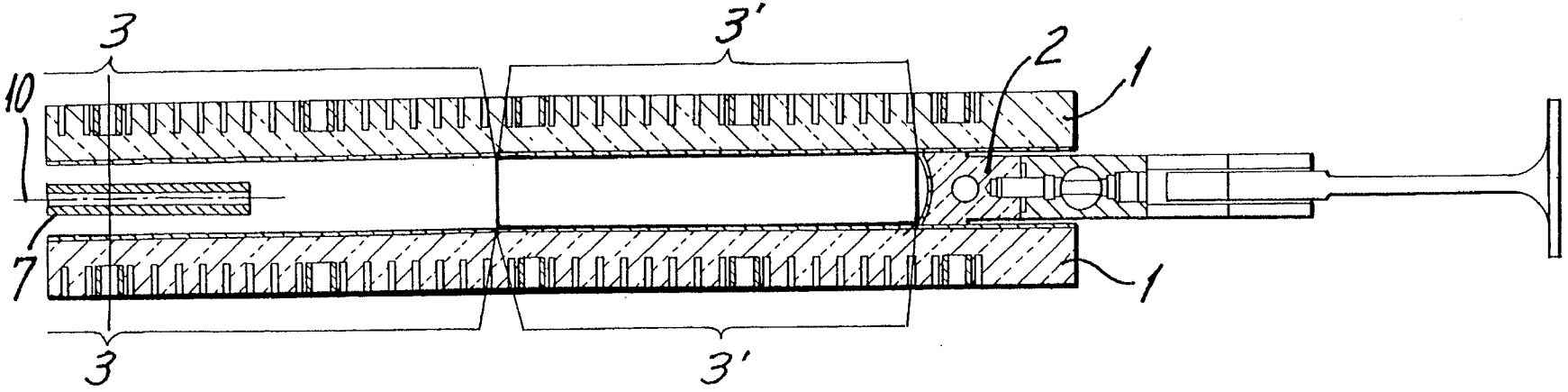
FIG. 2 is a partial view according to FIG. 1 showing the position of the narrow sides for a maximum slab width.
Figure 3:
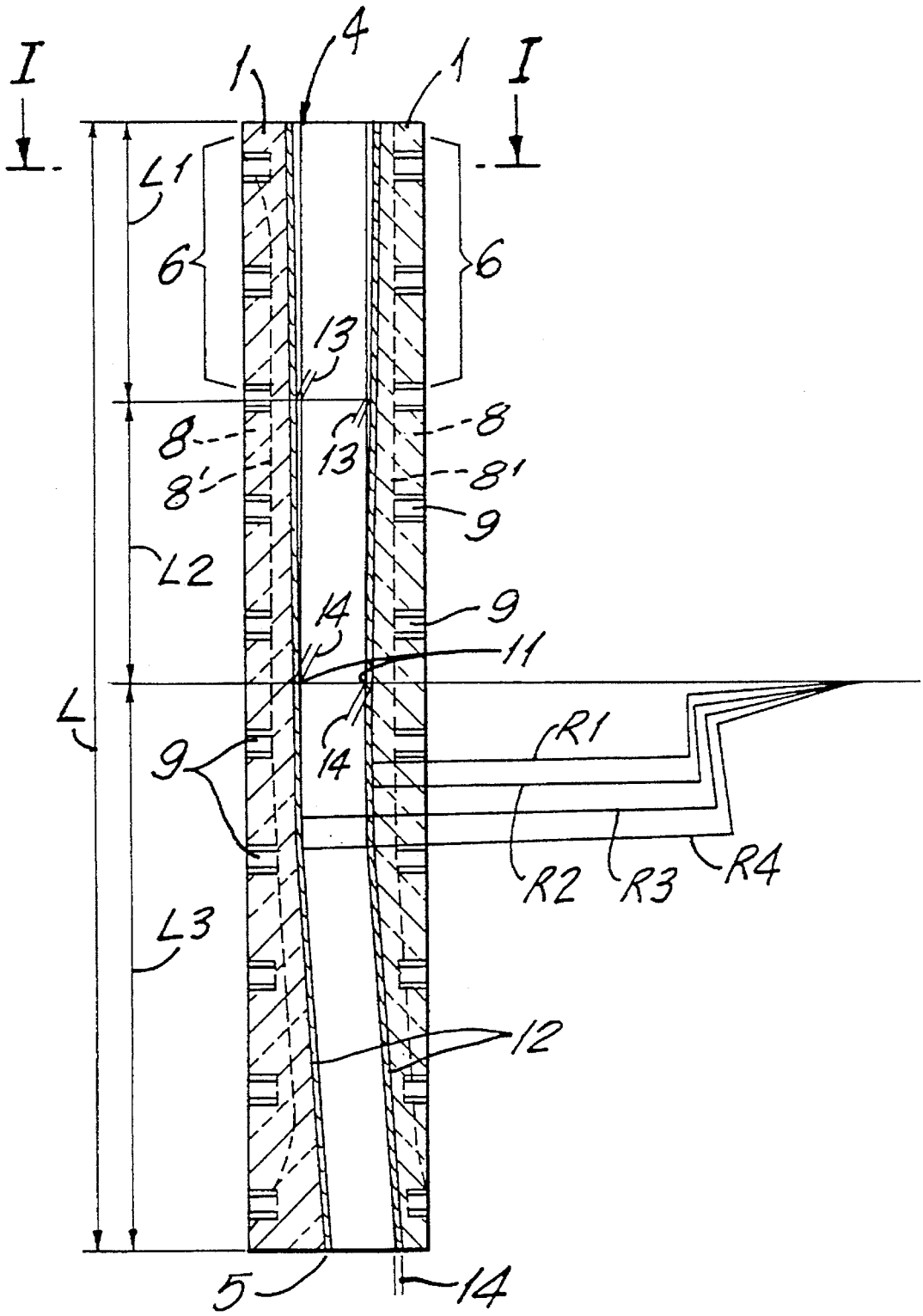
FIG. 3 shows a longitudinal section III—III according to FIG. 1.
Figure 4:
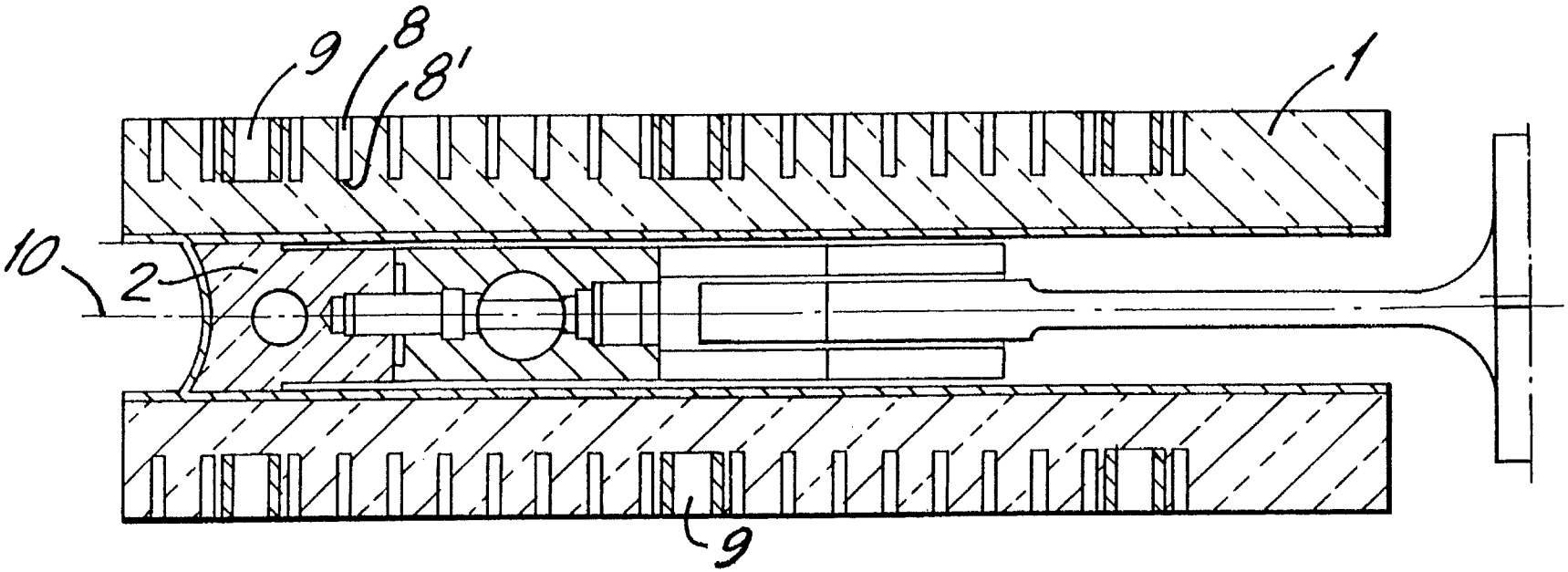
FIG. 4 is an enlarged view showing the adjusting region of the ingot mold according to FIGS. 1 and 2.

Example:

Lateral regions 3' within which the narrow side plates 2 can be adjusted, adjoin the region 3 of the broad side plates I for the purpose of increasing the slab width (FIG. 2). These regions 3' extend along the entire height of the ingot mold with a constant cross-sectional surface for the billet to be produced. The broad side plates 1 are formed in the region 3' in such a way that the surface enclosed by the broad sides forms an isosceles trapezoid as seen from the top proceeding from the lateral sides of the rectangle shown in the drawing, so that the larger base line of the trapezoid coincides with the lateral sides of the rectangle shown in the drawing. The base line of the trapezoid is 0.4 mm longer than the opposite side. In view of this slope of the region 3' the contact pressure of the broad side plates pressing against the narrow side plates decreases at first when adjusting the width. The narrow side plates are then displaced and the broad side plates are then pressed against subsequently. The described construction of the broad side plates 1 is applicable in straight and curved ingot molds and also in curved ingot molds with a plurality of different radii of curvature, as is shown in FIG. 3 and designated by R1–R4.

FIG. 5 shows an ingot mold having a straight portion 6 with adjoining curved part on the pour-in side. The submerged nozzle 7, which serves for the melt feed and is elongated in cross section, projects into the straight portion 6 of the ingot mold. The broad side plates I are cooled by means of water which is guided through ducts S in the rear side of the shape-imparting wall which is produced from copper. The copper walls are fastened in a conventional manner, via bolts engaging in recesses 9, to a plate, not shown, which simultaneously covers the ducts.

The depth of the cooling ducts S, at least in the upper half of the ingot mold, is so dimensioned that the distance of the duct base 8' from the center 10 of the ingot mold to the narrow side walls 2 as seen from the top increases relative to the surface of the broad side plate 1 facing the melt.

In FIG. 5, a region in which the apex height of the curve decreases linearly toward the ingot mold outlet 5 adjoins the region 6 of constant apex height 13 which comprises approximately one third of the height of the ingot mold and in every case covers the casting level region.

FIG. 3 shows another embodiment form. In this case, the ingot mold includes three regions L1, L2, L3 with different apex heights 13 of the curve. The region 6, which is also designated by L1, corresponds to that described in FIG. 5. In the adjoining portion L2 which terminates approximately in the vertical center of the ingot mold at L1, the apex height 13 is reduced linearly to an amount 14 which corresponds to that at the ingot mold outlet 5. The lower portion 12 of the ingot mold accordingly has a constant apex height 13.

Figure 6:
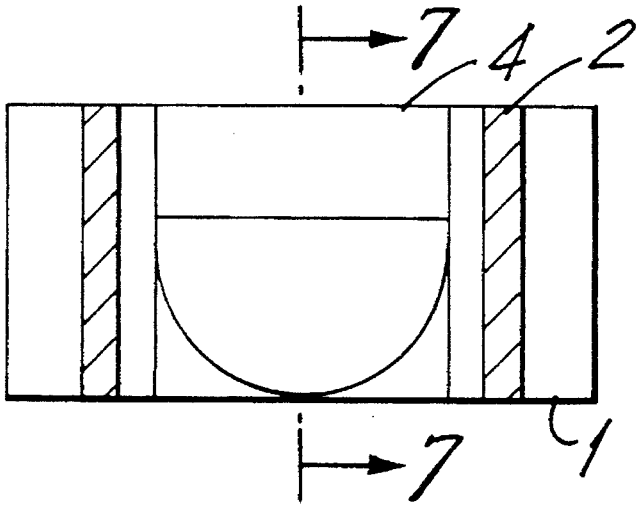
FIGS. 6,7,8 show a modified construction in sections.
Figure 7:
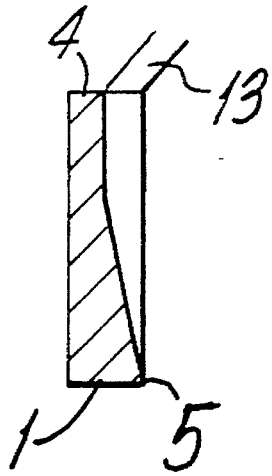
Figure 8:
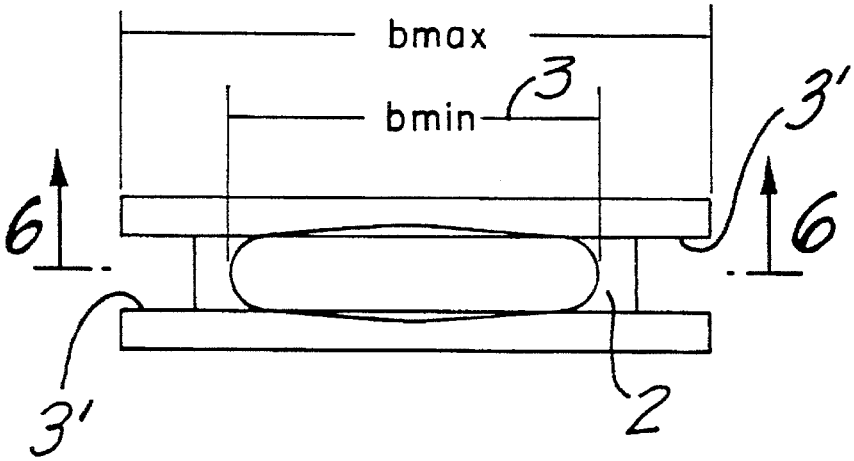

Whereas a certain camber is also present at the lower edge 5 of the ingot mold in the constructions described above, in the construction according to FIGS. 6 to 8 the shape of the broad side plates I at the lower edge—i.e. at the bill outlet end—of the ingot mold corresponds to the billet format to be produced. The transition from the cambered pour-in side 4 to the lower edge 5 clearly follows from the steps shown in FIGS. 6 to 8.

The process realized with the ingot mold according to the invention for producing a slightly cambered slab or thin slab results in the following advantages:

- uniform material flow of the rolling stock along the strip width in the roll gap and accordingly
- highly consistent section of the finished strip,
- centric running of the slab or rolling stock in the ingot mold and from one pair of rollers or rolls to the other.

The centric running of the slab in the ingot mold leads to the following advantages in technical respects relating to casting:

- uniform, specific conduction of heat into the narrow and broad side copper plates and in both the horizontal and vertical directions,
- uniform gap formation between the billet shell and copper plate in the casting level region,
- uniform lubricating film formation of the casting slag,
- the shrinking process of the billet, particularly in the width direction, is not hindered or blocked by means of parallel broad side copper plates, but rather is facilitated by the camber,
- increase in the temperature profile along the slab width in the region adjacent to the narrow side edges.

What is claimed is:

1. A liquid-cooled plate mould with adjustable width for the continuous casting of billets from steel in the form of slabs having a thickness of less than 100 mm, the mould having a pour-in side (4), and slab outlet end (5) and a direction of casting; the mould comprising:

- oppositely disposed broad side plates (1) forming in the direction of casting a pair of curved mould walls;
- narrow side plates (2) slidably disposed between the broad side plates for increasing the width of the slab along a region of adjustment (3') extending from a smallest slab width to a relatively larger slab width, the narrow side plates being arranged substantially parallel to one another along the height of the mould;
- the broad side plates (1) including a cavity extending along at least the smallest slab width, the cavity having a curve length, a chord length and a depth (13), the depth of the cavity of the curved mould being at most 12 mm per 1,000 mm slab width at the pour-in side (4) of the mould;

the shape of the broad side plates (1) at the slab outlet end (5) of the mould corresponding to the slab being produced, the broad side plates (1) being constructed so as to be concave at the slab outlet end (5) of the mould in such a way that the depth (13) of the mould walls forming the curve is still at least 0.5 to 2 mm as seen in cross-section;

the broad side plates having a plane inner surface in the region of adjustment (3') of the narrow side plates (2); and a plurality of ducts (8) within the broad side plates (1) for cooling the mould.

2. The mould according to claim 1, wherein tile depth (13) continuously decreases from the pour-in side (4) of the mould to the slab outlet end (5) of the mould.

3. The mould according to claim 1, wherein the depth (13) on the pour inside (4) is between 5 and 12 mm.

4. The mould according to claim 1, wherein the depth (13) is constant along a first section (6) comprising a third of the mould height (L).

5. The mould according to claim 4, further comprising a second section (L2) terminating at approximately half the height (L) of the mould (at 11) and adjoining the first section (6) of constant depth (13); the depth of the second section decreasing linearally in the direction of casting.

6. The mould according to claim 5, further comprising a third section (L3) having a constant depth, the third section (L3) terminating at the mould outlet end (5) and adjoining the second section (L2).

7. The mould according to claim 1, wherein the length of the curve of a broad plate in the direction of the width of the mould in the region (3) when the slab has its smallest width is no more than 20% of the shrinkage of the slab relative to the chord length (20).

8. The mould according to claim 1, further comprising a center plane (III—III) and the broad side plates comprising a surface facing the slab; and wherein each cooling duct comprises a duct floor (8'), the distance of the duct floor (8') of the mould as seen from the top increasing from the center plane (III—III) of the mould to the narrow side plates (2) relative to the surface of the broad side plates (1) facing the slab.

9. The mould according to claim 8, further comprising a central plane (10) extending along the width of the mould; and wherein a duct floor (8') of the duct (8) of the side wall lies in a plane parallel to the central plane (10) at least in the tipper half of the mould.

10. The mould according to claim 1, further comprising a central plane (10) extending along the width of the mould and wherein the broad side plates (1) are constructed as a plane surface in the region of adjustment (3') and are inclined relative to the central plane (10) commencing from the portion (3) of the smallest slab width and are a constant distance from one another from the pour-inside (4) to the outlet end (5) of the mould.

* * * * *

UNITED STATES PATENT AND TRADEMARK OFFICE

CERTIFICATE OF CORRECTION

PATENT NO. : 5,467,809

DATED : November 21, 1995

INVENTOR(S) : Giovanni ARVEDI, et al.

It is certified that error appears in the above-indentified patent and that said Letters Patent is hereby corrected as shown below:

On the title page, item

[73] Assignee: should read as follows

Mannesmann Aktiengesellschaft
Düsseldorf, Germany and

Giovanni Arvedi,
Cremona, Italy

Signed and Sealed this

Nineteenth Day of November, 1996

*Attest:*

Bruce Lehman

BRUCE LEHMAN

*Attesting Officer*

*Commissioner of Patents and Trademarks*